United States Patent [19]

Mirando et al.

[11] Patent Number: 5,014,991

[45] Date of Patent: May 14, 1991

[54] AMUSEMENT GAME

[75] Inventors: Salvatore V. Mirando, Holmdel; Walter Lee, Farmingdale, both of N.J.

[73] Assignee: SMS Manufacturing Co., Ltd., Lakewood, N.J.

[21] Appl. No.: 451,752

[22] Filed: Dec. 15, 1989

[51] Int. Cl.[5] ..... A63B 71/00; A63F 7/00

[52] U.S. Cl. ..... 273/138 A; 273/138 R; 273/118 A; 273/119 A; 273/85 CP; 273/123 A

[58] Field of Search ..... 273/85 CP, 118 A, 118 D, 273/119 R, 119 A, 123 R, 123 A, 125 A, 138 R, 138 A

[56] References Cited

U.S. PATENT DOCUMENTS

| | | | |
|---|---|---|---|
| 2,317,506 | 4/1943 | Williams et al. | 273/123 A |
| 2,710,756 | 6/1955 | Hooker | 273/125 A |
| 2,853,304 | 9/1958 | Hooker | 273/125 A |
| 3,275,322 | 9/1966 | Burnside | 273/119 A |
| 3,399,896 | 9/1968 | Burnside | 273/123 A |
| 3,901,511 | 8/1975 | Garbark | 273/123 A |
| 4,311,311 | 1/1982 | Crosman | 273/123 A |
| 4,375,286 | 3/1983 | Sritz et al. | 273/138 A |

FOREIGN PATENT DOCUMENTS

| | | | |
|---|---|---|---|
| 586055 | 3/1947 | United Kingdom | 273/123 R |

*Primary Examiner*—Edward M. Coven
*Assistant Examiner*—Jessica Harrison
*Attorney, Agent, or Firm*—Mathews, Woodbridge & Collins

[57] ABSTRACT

The poker amusement game includes five rubber balls and a playing field with twenty-five openings in which the rubber balls may reside. A microprocessor has inputs connected to a plurality of switches for determining the location of the five balls, a plurality of outputs connected to solenoids to be used for ejecting the balls from the openings, and an output connected to a video display for displaying messages to the player concerning the play of the game, the points received, etc. When the microprocessor detects that a coin has been inserted and that the DEAL/DRAW switch has been pushed, the locations of the five balls are sensed and the corresponding ejectors are energized to eject the balls in a manner that causes the balls to randomly bounce in the playing area. Balls coming to rest in the openings cause switches to close which in turn, will cause the microprocessor to display on the video the identity of the poker card represented by the occupied openings. The player may discard balls by first activating appropriate DISCARD switches and then activating the DEAL/-DRAW switch. In response, the microprocessor energizes the corresponding solenoids to eject the chosen discarded balls from their openings. The final hand is evaluated when the discarded balls come to rest in their new positions. Tickets or tokens are awarded based on the value of the final hand.

9 Claims, 9 Drawing Sheets

AMUSEMENT GAME

BACKGROUND OF THE INVENTION

1. Field of the Invention

The present invention relates to an amusement game and, in particular, to a game having a plurality of playing pieces that are operator-selected for random manipulation by a machine.

2. Description of the Related Art

In the field of coin-operated amusement devices, it has been the general practice to employ various types of machines having playing pieces capable of being manipulated by the machine to simulate a conventional game of chance, such as poker, roulette, craps, etc. For example, poker machines often include five playing pieces that are manipulated onto a playing field where they come to rest in one of a number of possible combinations of positions each of which represent a different poker hand. Depending on the value of the poker hand, the player is awarded a specific number of points. Designers of these poker machines have often tried to increase their level of amusement by introducing some element of operator skill into the operation of the machine. For example, some poker machines introduce skill by including playing pieces that must be skillfully manipulated by the player to obtain winning combinations with higher point values. Although, such devices have served the purpose, they have not proved entirely satisfactory for the reason that the game being simulated, poker, does not normally involve the skillful manipulation of playing pieces. An example of a skill employed in the game of poker involves the choosing of discards to improve the value of the hand. As such, designers of such games have long recognized the need for amusement devices that introduce an element of skill into a machine game that more closely resembles the skills used in playing the actual game being simulated. The present invention fulfills this need.

SUMMARY OF THE INVENTION

The general purpose of this invention is to provide an amusement device which embraces all the advantages of similarly employed prior art devices while requiring of the operator skills that closely resemble the skills used in playing the game being simulated. To attain this, the present invention contemplates a unique machine having a plurality of playing pieces and a playing field with a number of positions in which the pieces may reside. Each position corresponds to a unique game feature, such as the various cards in a poker deck. A plurality of machine manipulators are associated with the various positions for randomly moving the pieces to other positions on the playing field. A discard selection device is manipulated by the operator to select one or more playing pieces on the playing field for further manipulation by the machine in the hopes of improving the value of the present combination.

As such, this invention is readily useable to simulate the game of draw poker. To simulate draw poker, the initial poker hand may be dealt by having the machine manipulator move five playing pieces onto a playing field where the pieces randomly come to rest in five different positions corresponding thereby establishing a poker hand. The player then evaluates the value of the poker hand and, in the hopes of increasing the value of the hand, makes a decision as to which of the five pieces are to be kept and which are to be discarded. Next, the player makes the discard selection by activating switches to identify the pieces to be discarded and then requests a draw. At this point, the machine manipulators will randomly move the discarded pieces to new positions on the playing field. The new hand is now evaluated by the machine and points are awarded.

The present invention closely resembles the actual game of draw poker in two critical respects. First, the player is given the opportunity to discard one or more pieces (cards) for the purpose of improving the poker hand. Second, the construction of the playing pieces, the machine manipulators and the playing field are such that it is clearly visible to the player that a random selection of the hand is being made as is the normal case in draw poker where the cards are randomly shuffled, cut and dealt.

The exact nature of this invention as well as other objects and advantages thereof will be readily apparent from consideration of the following specification relating to the annexed drawing.

DETAILED DESCRIPTION OF THE PREFERRED EMBODIMENT

Figure 1:
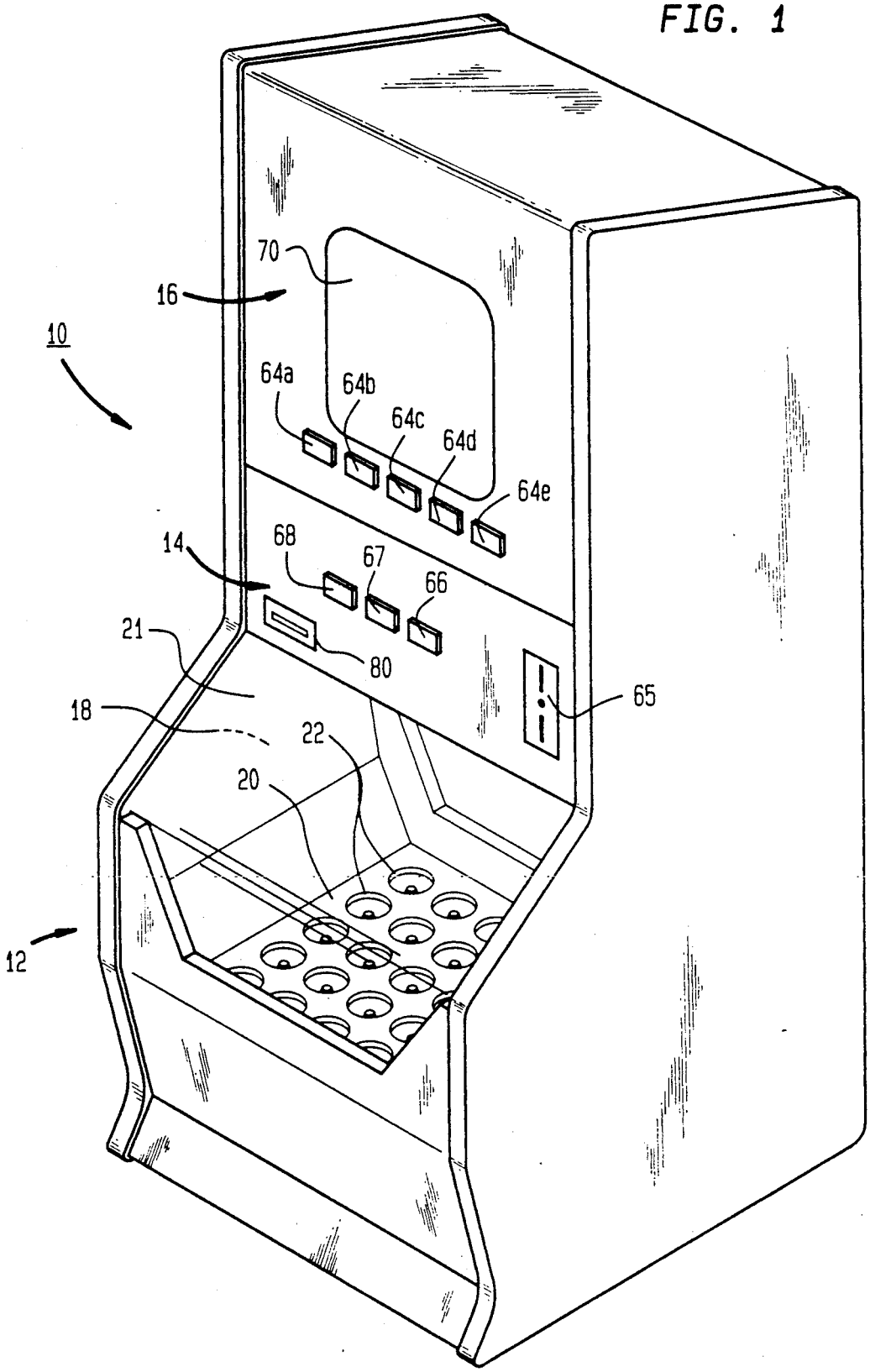
FIG. 1 is a pictorial view of the preferred embodiment.
Figure 2:
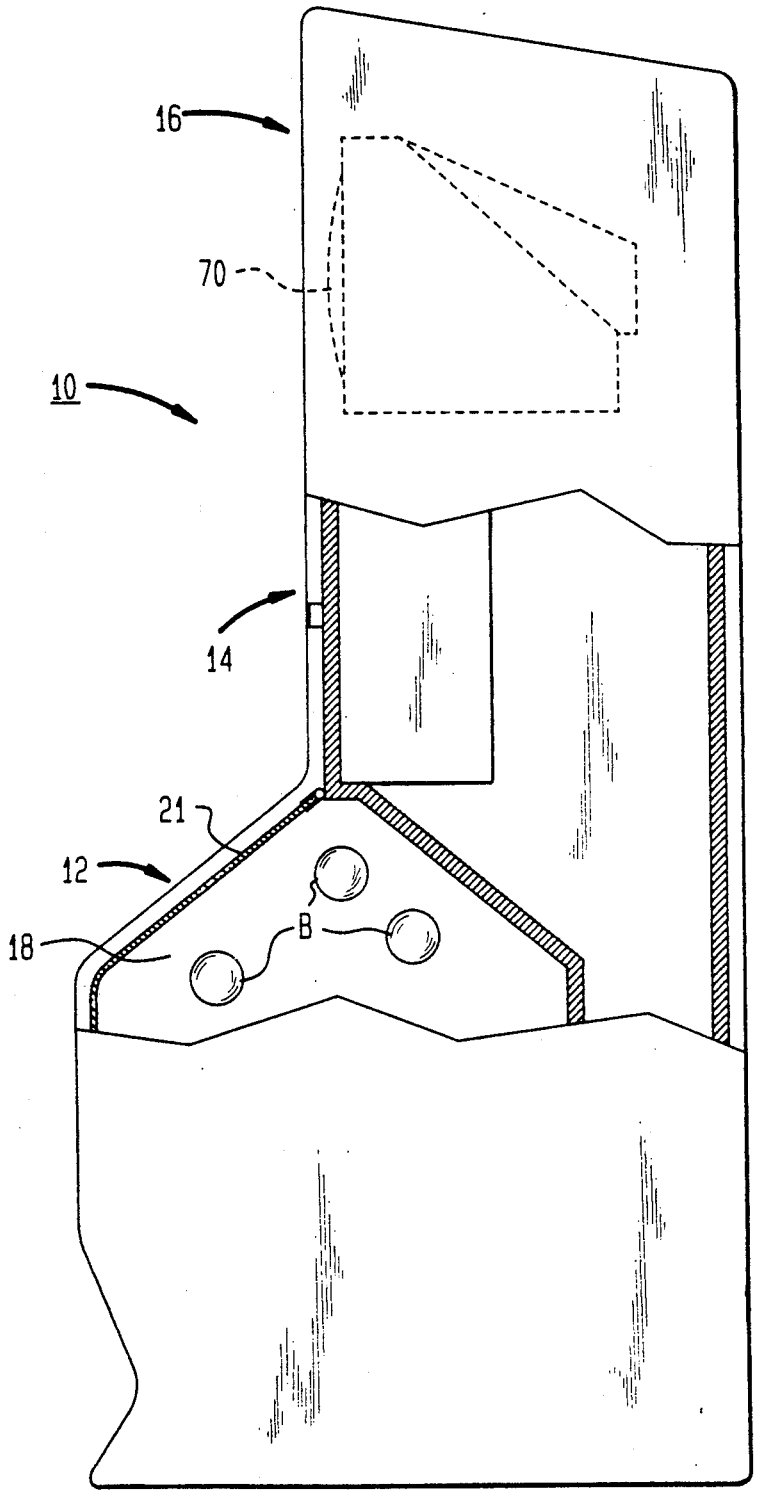
FIG. 2 is a side elevation, partly broken away, of the apparatus shown in FIG. 1.

Referring now to the drawings, there is shown an amusement game 10 having a playing portion 12, a control portion 14 and a display portion 16. The playing portion 12 includes a chamber 18 defined by a horizontal playing field 20 and a plurality of walls including a transparent front wall 21 through which the chamber 18 may be observed by a player.

The playing field 20 includes upper and lower surfaces with a plurality of concentric openings that form a plurality of holes 22 arranged in a rectangular array. Indicia are inscribed on the field 20 adjacent the holes 22 that identify the value assigned to each of the openings 22. The playing field 20 is mounted on a rigid frame 24 that includes a plurality of depending flanges 26 on which a plurality of solenoid ejectors 28 are each mounted coaxially with one of the holes 22. Also mounted on flanges 26 are a plurality of spring-biased, electrical switches 32. Each switch 32 is mounted just below a different one of the ejectors 28.

Each ejector 28 includes a coil 40, forming an electromagnet, and an armature 41. A nonmagnetic tubular pipe 42, preferably made of brass, is fixed in the center of coil 40. The armature 41 consists of a nonmagnetic tube 45 having a magnetic slug 43 fixed to its lower end.

Tube 45 may be made of brass and slug 43 may be made of iron. The armature 41 is free to move beyond the upper end of the pipe 42 while the slug 43 is confined to the interior of pipe 42 by the tapered ends thereof. A plunger 50 has a shaft 47 that is slidably mounted in the tube 45. A plunger head 48 is fixed to the upper end of shaft 47. The plunger 50 is carried by the armature 41 and is free to move with respect to armature 41 to one extreme (FIG. 7B) where head 48 contacts the upper end of tube 45 and a second extreme (FIG. 7C) where a stop flange 49, fixed to the lower end of shaft 47, contacts the lower end of tube 45.

Figure 7A:
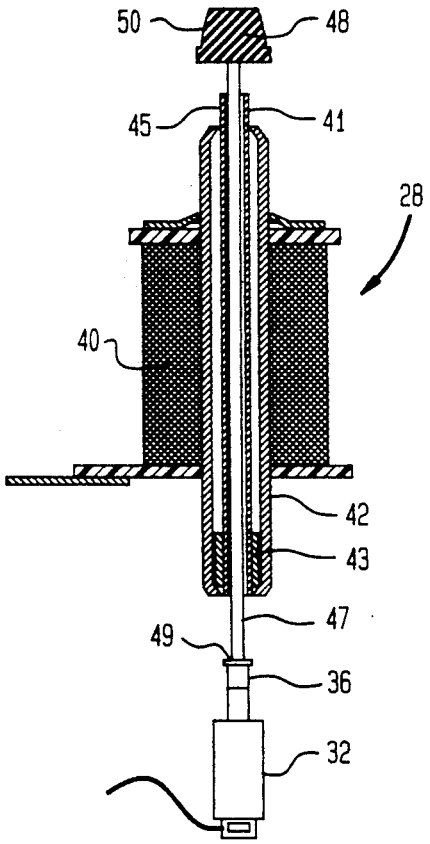
FIGS. 7A–7C are cross sections of a detail of the preferred embodiment showing the ejectors in various operating positions.
Figure 7B:
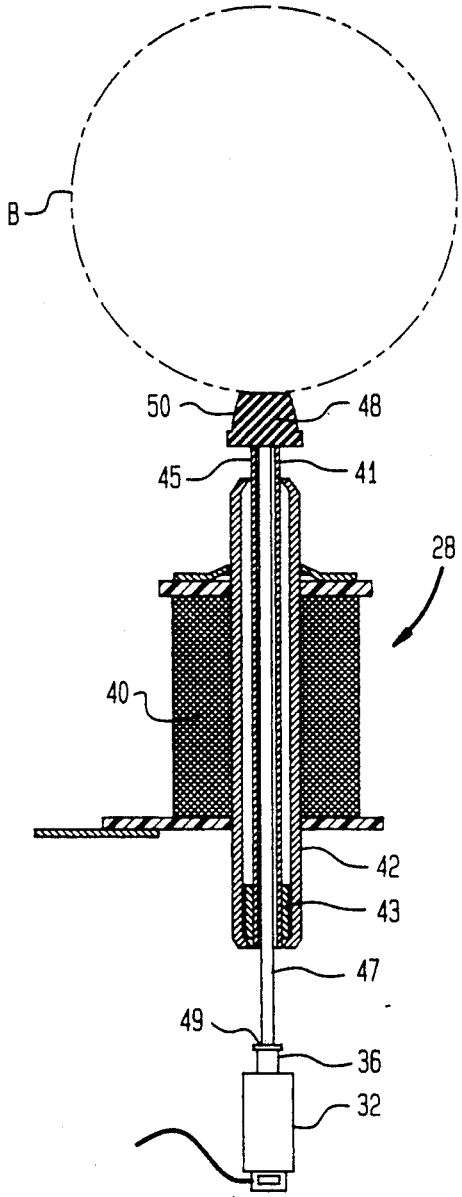
Figure 7C:
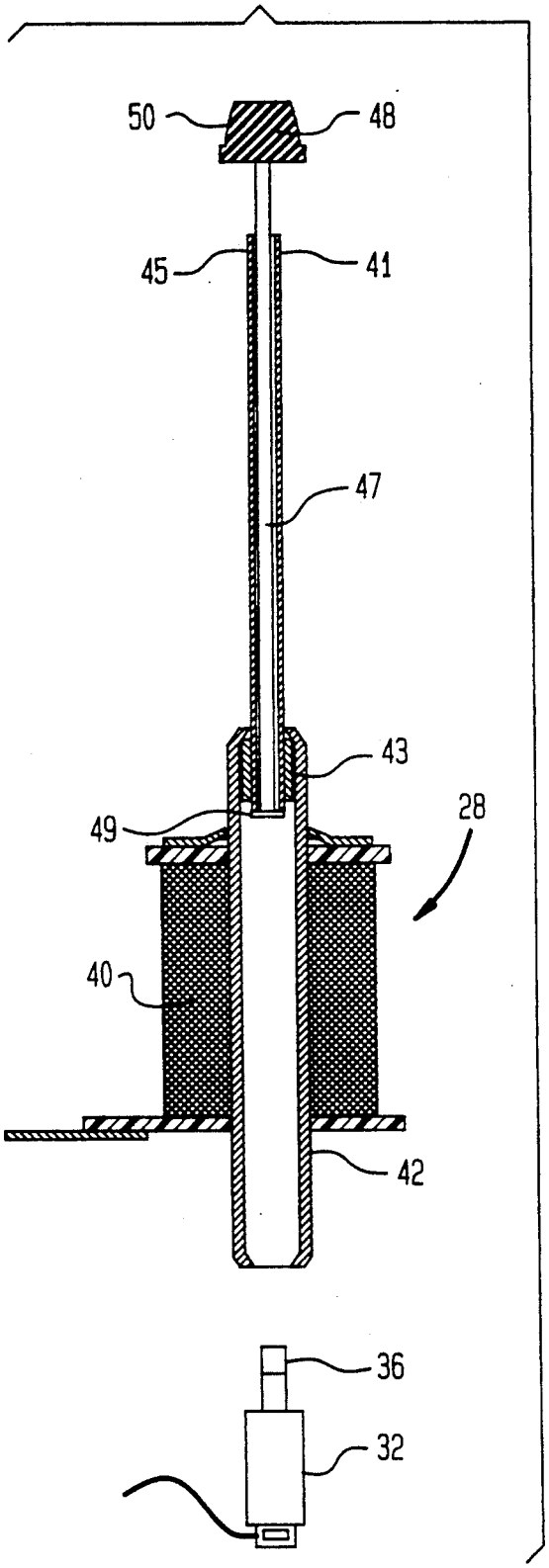

As seen in FIG. 7A, the ejector 28 and switch 32 are mounted such that the lower end of shaft 47 normally rests on the actuator 36 of switch 32 when the coil 40 is not energized. As seen in FIG. 7B, when a ball B of sufficient weight rests on the head 48, the ball B will cause plunger 50 to force the actuator 36 down to activate the switch 32. As will be seen later, the state of switch 32 is sensed to determine if a ball B has come to rest in the associated opening 22. Upon energizing coil 40, in a manner to be described below in detail, the slug 43 will be magnetically forced upwardly, thereby propelling the armature 41, plunger 50 and ball B upwardly. These moveable elements of the ejector 28 will be propelled upwardly as a unit to the extreme position shown in FIG. 7C. As a result, the ball B will be ejected from the hole 22 and propelled against one or more of the walls that define chamber 18. The balls B, being made of rubber, will continue to randomly bounce in chamber 18 until their energy is expended at which time they will come to rest in holes 22.

Figure 8:
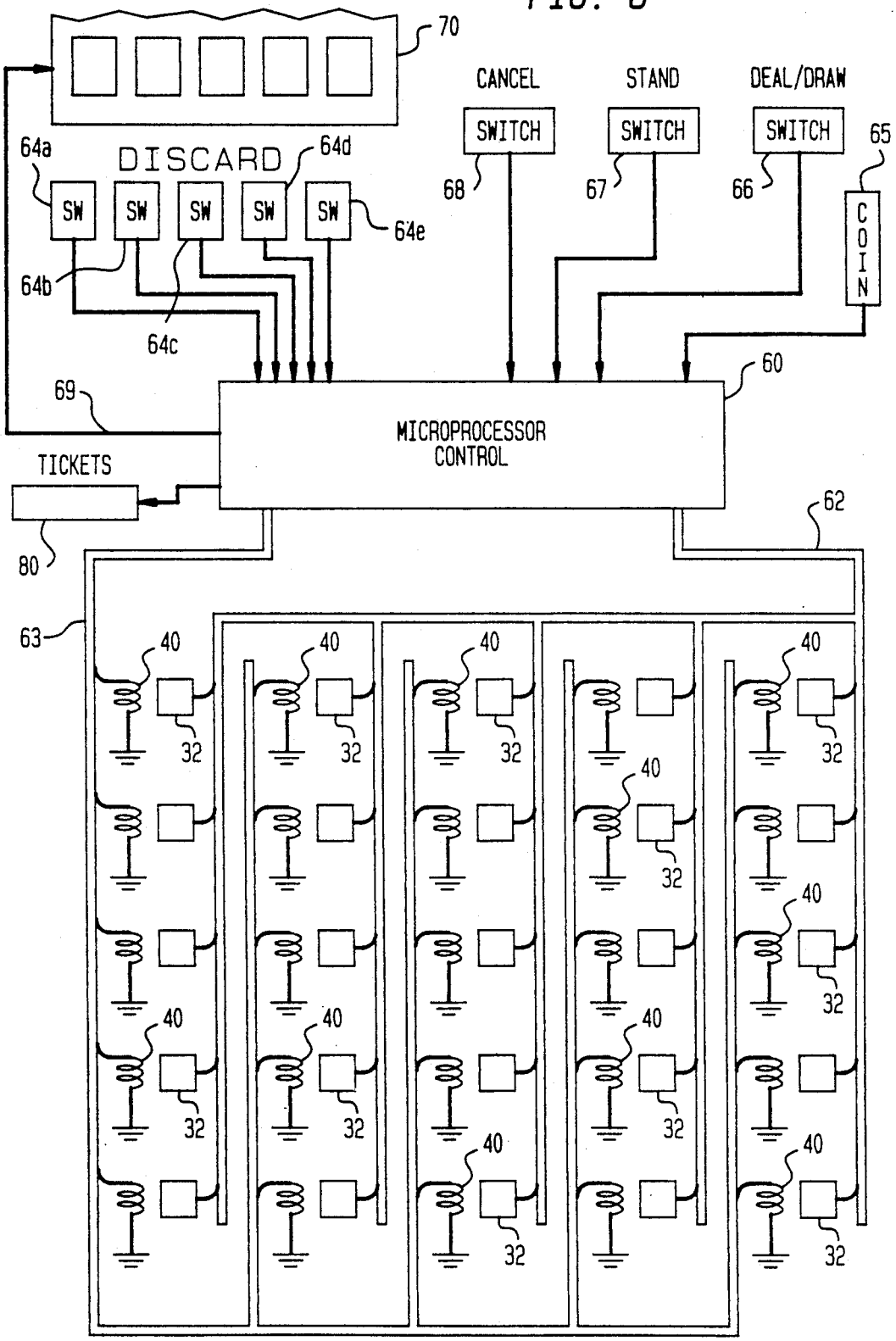
FIG. 8 is an electrical block diagram of the preferred embodiment.

FIG. 8 illustrates a preferred control circuit for operating the amusement game 10. A microprocessor control 60 is connected individually to each of the switches 32 and the coils 40 via buses 62, 63, respectively. Five DISCARD switches 64*a*–64*e* are connected to microprocessor control 60 along with COIN switch 65, DEAL/DRAW switch 66, STAND switch 67 and CANCEL switch 68. The control 60 has a video output line 69 connected to a video display 70. The microprocessor control 60 comprises one or more conventional microchips programmed for executing stored instructions for playing a predetermined game such as draw poker.

Figure 3:
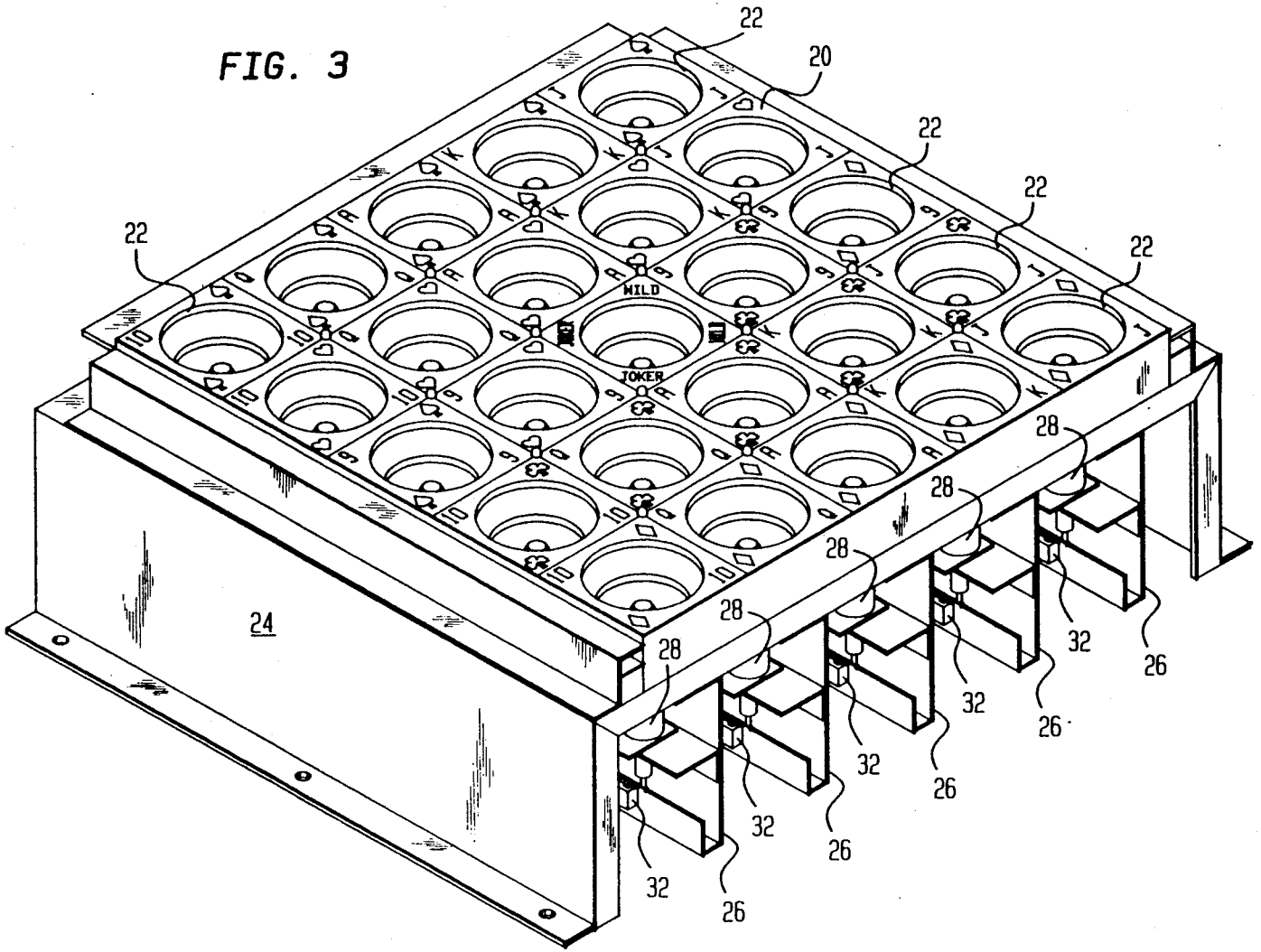
FIG. 3 is a pictorial view of a portion of the apparatus shown in FIG. 1.
Figure 4:
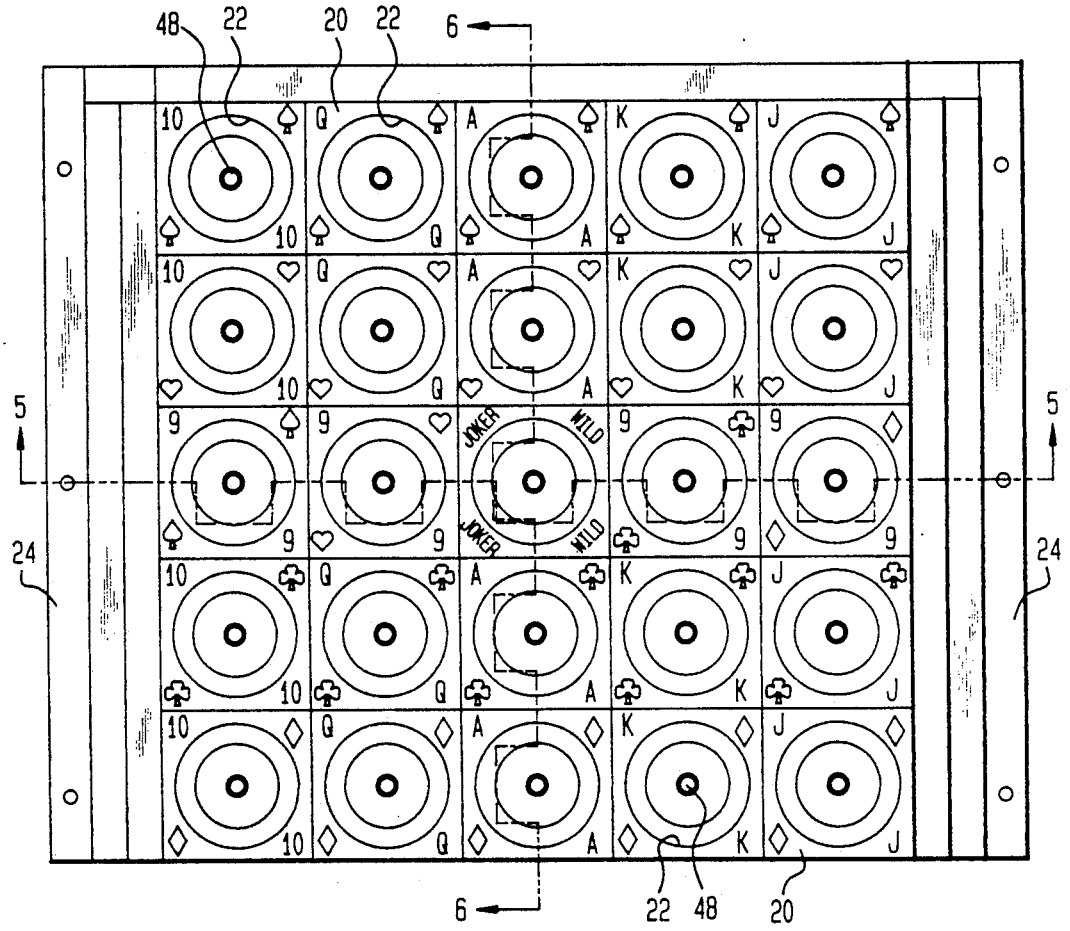
FIG. 4 is a top view of the device shown in FIG. 3.
Figure 6:
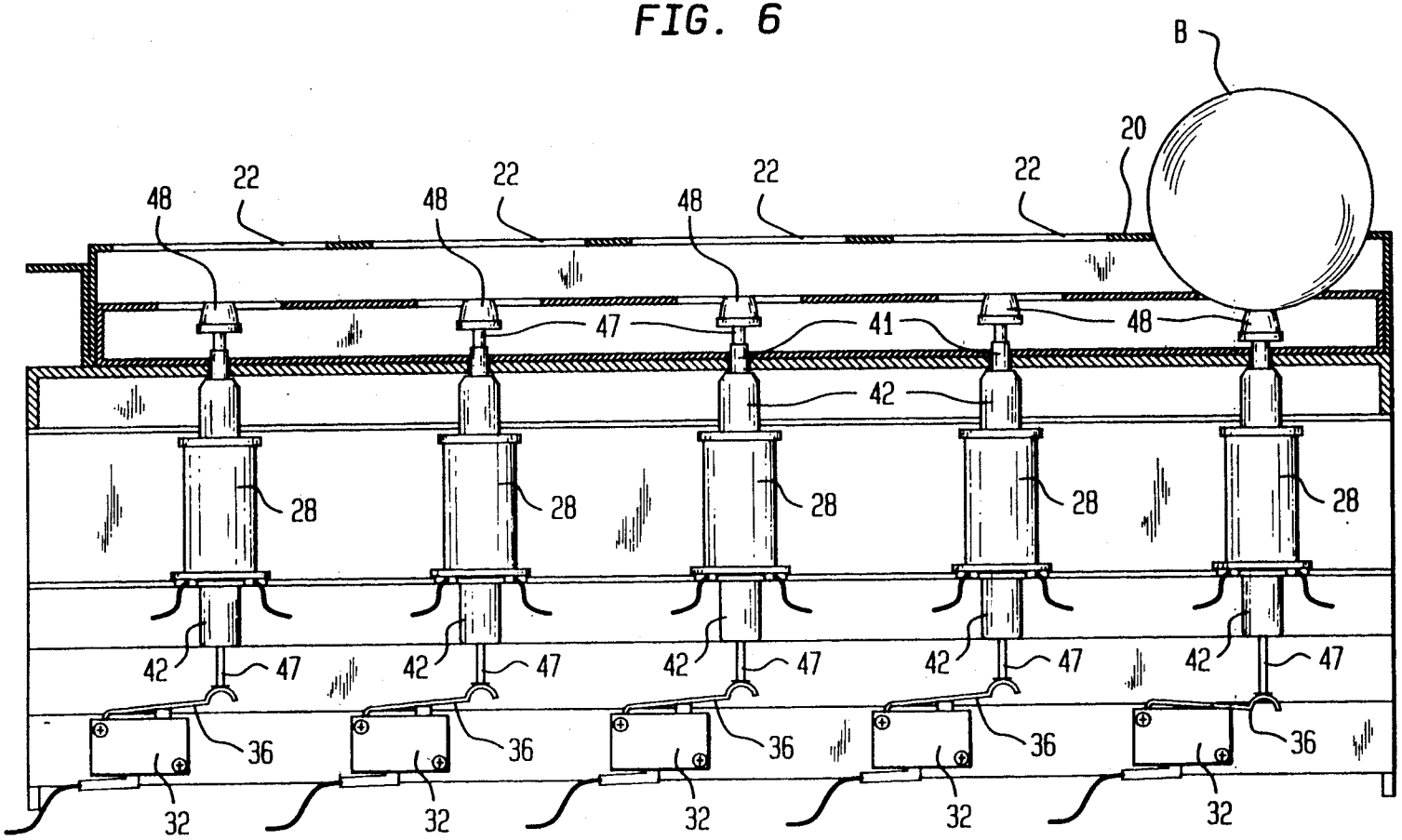
FIG. 6 is an elevation in cross section taken on the line 6—6 of FIG. 4 looking in the direction of the arrows.
Figure 5:
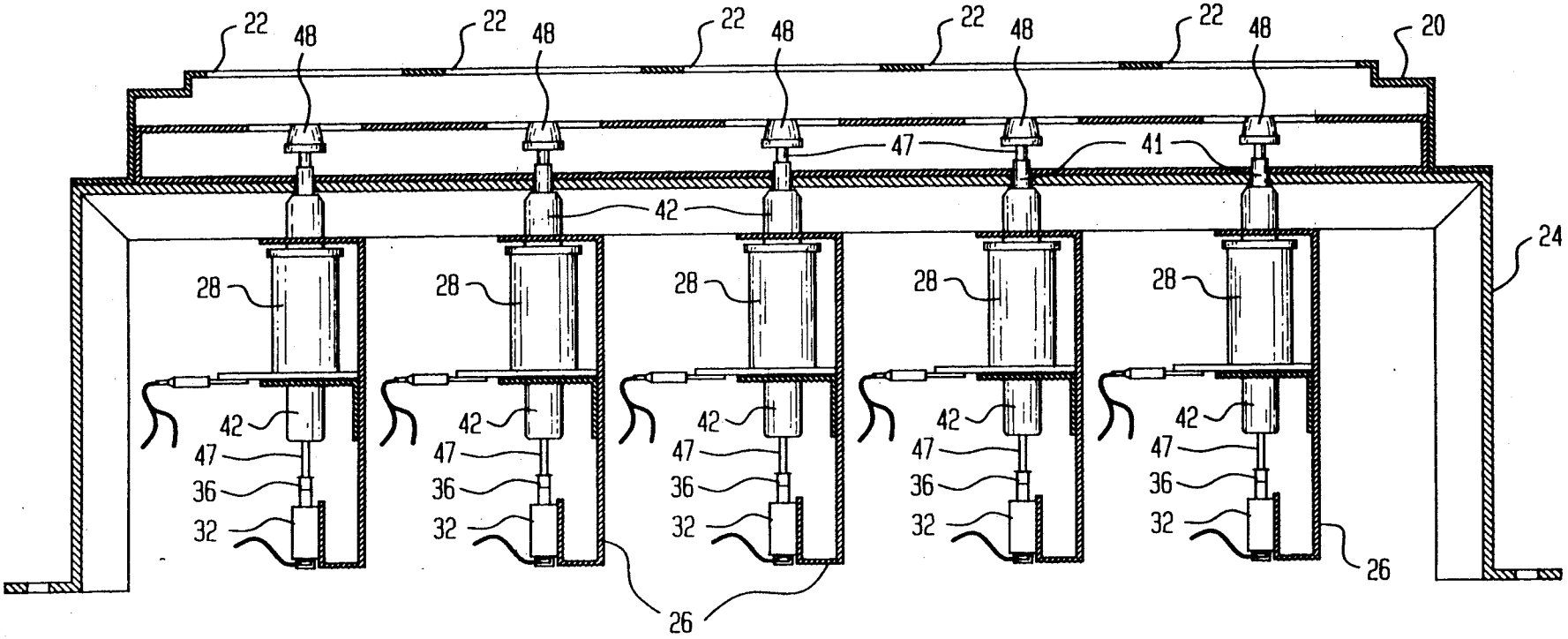
FIG. 5 is an elevation in cross section taken on the line 5—5 of FIG. 4 looking in the direction of the arrows.

In playing the game of draw poker, five balls B are introduced into chamber 18. The holes 22 are each assigned a different card value, as shown in FIGS. 3, 4. The embodiment shown in the drawings has holes 22 arranged in a five-by-five square array with the center hole 22 assigned to be a wild card (Joker). The remaining twenty-four holes 22 are assigned conventional card values ranging from the four nines to the four aces. A larger version which employs all of the conventional fifty-two cards may be readily designed using the principles of the present invention.

The player beings play by inserting the proper coins to operate the COIN switch 65. In response, the control 60 will scan the lines in bus 62 to determine which of the five switches 32 are activated, thereby sensing the locations of the five balls B. The player next presses the proper button to operate DEAL/DRAW switch 66, causing control 60 to energize the five coils 40 associated with the five activated switches 32. As such, the five balls B are ejected from the holes 22 and are randomly bounced against each other, the playing field 20 and the walls of chamber 18. The five balls B will eventually come to rest in five of the holes 22. Their locations will again be sensed by control 60 via bus 62 and their values will be displayed on the display 70 by showing a row of five cards oriented in a manner similar to the row of DISCARD switches 64*a*–64*e*.

Next the player chooses which cards, if any, are to be discarded by pressing the buttons to activate one or more of the DISCARD switches 64*a*–64*e* that correspond to the positions of the cards to be discharged as shown on display 70. If the player wishes to change his or her mind, the CANCEL switch 67 may be activated to cause control 60 to reset the DISCARD switches 64*a*–64*e*. Also, if a player decides not to discard a ball B, the STAND switch is activated.

When the player is finished selecting the cards to be discarded, the DEAL/DRAW switch 66 is activated. In response, the control 66 will energize the coils 40, via the proper lines in bus 63, associated with the chosen discarded cards. The corresponding balls B are then ejected from the holes 22 by ejectors 28. The balls B that are not to be discarded will remain in their original holes 22. After the ejected balls B again come to rest in holes 22, the control 60 will sense their new locations and evaluate the value of the final hand. Winning tickets will be dispensed to the player via the ticket dispenser 80 and the amusement game will return to the original inactive state ready for a new game.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. An amusement game having playing pieces comprising:

a playing field having a first plurality of playing positions thereon, each position having means for containing a playing piece;

a deflector mounted adjacent said playing field;

a second plurality of playing pieces randomly contained in said playing position, wherein said second plurality is less than said first plurality;

a plurality of playing-piece sensors each mounted adjacent one of said positions;

a plurality of playing-piece ejectors each mounted adjacent one of said positions;

a manual ejector enabling means connected to said sensors and said ejectors for permitting selective, manual enabling of one or more of said ejectors mounted adjacent said positions in which a playing piece is contained; and a manual energization means for energizing those ejectors enabled by said enabling means for propelling the ejected pieces against said deflector for randomly deflecting said ejected pieces into said playing positions.

2. The game of claim 1 wherein said playing pieces are balls.

3. The game of claim 2 wherein said means for containing a playing piece is an opening in said playing field.

4. The game of claim 3 wherein each said ejector means is a solenoid having an armature mounted for movement into said opening in response to energization thereof by said energization means.

5. The game of claim 4 wherein each said sensor includes a switch having activator means extending into said opening for being depressed by a ball to activate said switch.

6. The game of claim 5 wherein said activator means includes a plunger slidably extending through said armature.

7. The game of claim 6 wherein said enabling means further includes a video display means for displaying the game value of the combination of the positions containing the playing pieces.

8. The game of claim 7 further including a ticket dispenser means for awarding tickets as a function of the playing value of the combination of the positions containing the playing pieces.

9. The game of claim 8 further including a money activated control means for initiating the operation of said game.

* * * * *